US006854922B1

(12) United States Patent
Nicks

(10) Patent No.: US 6,854,922 B1
(45) Date of Patent: Feb. 15, 2005

(54) LOCKING COVER FOR A SOFFIT MANHOLE

(75) Inventor: Curtis D. Nicks, San Leandro, CA (US)

(73) Assignee: Santa Clara Valley Transportation Authority, a public agency, San Jose, CA (US)

( * ) Notice: Subject to any disclaimer, the term of this patent is extended or adjusted under 35 U.S.C. 154(b) by 0 days.

(21) Appl. No.: 10/629,290

(22) Filed: Jul. 28, 2003

(51) Int. Cl.[7] ..... E02D 29/14
(52) U.S. Cl. ..... 404/25; 52/19
(58) Field of Search ..... 404/25, 26; 52/19, 52/20

(56) References Cited

U.S. PATENT DOCUMENTS 2,997,932 A * 8/1961 Taylor ..... 404/26
3,969,847 A * 7/1976 Campagna et al. ..... 52/1
4,935,129 A * 6/1990 Wang ..... 210/131
4,964,755 A 10/1990 Lewis et al.
5,082,392 A 1/1992 Marchese et al.
5,324,135 A 6/1994 Smith
5,769,564 A * 6/1998 Hawkins ..... 404/25
5,987,824 A 11/1999 Fuller
6,347,781 B1 * 2/2002 Trangsrud ..... 249/11
6,435,763 B1 8/2002 Sakane et al.
6,743,360 B2 * 6/2004 Petersen et al. ..... 210/541

FOREIGN PATENT DOCUMENTS

FR 0084510 A1 * 7/1983 ..... E02D/29/14

* cited by examiner

*Primary Examiner*—Robert E. Pezzuto
*Assistant Examiner*—Raymond W. Addie
(74) *Attorney, Agent, or Firm*—Kelly Lowry & Kelley, LLP

(57) ABSTRACT

A locking cover is provided for a manhole or other access opening formed in a soffit or the like, such as an access manhole formed in an otherwise enclosed overhead cell or chamber within a concrete overpass or bridge structure of a light rail or highway transportation system. The locking cover includes an upper section defined by multiple segments sized to fit upwardly through the manhole and then assemble to define a peripheral rim for seating upon an upper soffit surface generally circumscribing the manhole. A lower section includes a peripheral rim for substantially seated engagement with a manhole-circumscribing lower soffit surface, and carries a lock unit for releasible connection with a lock bolt depending from the assembled upper section. The lock unit is positioned within an access-restricting containment sleeve to resist and/or discourage tampering.

38 Claims, 7 Drawing Sheets

LOCKING COVER FOR A SOFFIT MANHOLE

BACKGROUND OF THE INVENTION

This invention relates generally to an improved manhole cover and related method of installation, particularly for use in lockably closing a manhole or other access opening formed in an overhead soffit structure to restrict access to an otherwise enclosed overhead cell or chamber formed, e.g., within a concrete overpass or bridge structure of a light rail or highway transportation system or the like. More specifically, the locking cover of the present invention is designed for securely closing the soffit manhole in a manner that substantially prevents unauthorized access to the overhead cell or chamber by unauthorized persons.

Modern overhead structures such as concrete overpasses and bridges used in rail and highway transportation systems often incorporate internal, substantially enclosed cells or chambers which are accessed from below through one or more hatch or access openings such as circular manholes formed in an overhead soffit structure. Such enclosed cells or chambers may be vacant, but sometimes house equipment or facilities such as components of a public utility system, e.g., water mains, sewer drain pipes, and electrical wiring and related conduits.

In the past, manhole covers in the form of metal plates have been provided for normally closing such soffit manholes to discourage access to these overhead enclosed cells or chambers by unauthorized persons such as vagrants or vandals. However, such manhole covers have been designed for relatively quick and easy slide-fit installation, and for correspondingly quick and easy slide-out removal for periodic or as-needed access by authorized personnel. Accordingly, such slide-fit manhole covers have provided little or no effective security against slide-out removal by unauthorized persons desiring to use the overhead cells or chambers as living quarters and/or for other nefarious activities including but not limited to damaging the overpass or bridge structure or the equipment and facilities carried thereby. Alternative manhole cover designs such as wedge-fit arrangements have been provided in an effort to discourage unauthorized removal from the access opening, but these too have been susceptible to unauthorized tampering and removal by enterprising individuals.

There exists, therefore, a need for further improvements in and to covers for use in closing soffit manholes, wherein the improved manhole cover is designed for secure, substantially tamper-proof locking to provide a high degree of security by precluding unauthorized access to an otherwise enclosed overhead soffit cell or chamber, and further wherein the locking manhole cover can be unlocked and removed or opened relatively quickly and easily by authorized personnel to accommodate as-needed access. The present invention fulfills these needs and provides further related advantages.

SUMMARY OF THE INVENTION

In accordance with the invention, a locking cover is provided for a manhole or other access opening formed in a soffit or the like, such as an access manhole formed in an otherwise enclosed overhead cell or chamber within a concrete overpass or bridge structure of a rail or highway transportation system. The locking cover includes upper and lower sections each including a peripheral rim. The upper and lower sections are adapted for locked interconnection with a peripheral margin of a soffit manhole clamped therebetween the peripheral rims. A lock unit is protectively carried by the lower section within a depending containment sleeve for releasible locked connection with the upper section, wherein the containment sleeve provides limited access to the lock unit and thereby discourages and/or resists tampering therewith. A secondary barrier may also be provided in spaced relation with the containment sleeve for further restricting access to the lock unit.

In one preferred form, the upper section of the locking cover comprises a plurality of part-circle segments adapted for bolt-together assembly to form the upper section of generally circular shape having said peripheral rim for rested support on an upper surface of the peripheral margin of a generally circular manhole or access opening. The part-circle segments are sized and shaped for individual or unassembled passage upwardly through the manhole, and for assembly at a location above the manhole to form the assembled upper section. A lock post is carried by the upper section as by welding to one of the part-circle segments and extends downwardly generally centrally from said upper section. A bolt port is also formed in the upper section in coaxial alignment with a threaded nut secured to an upper face thereof as by welding.

The lower section also has a generally circular shape defining said peripheral rim for engaging a lower or underside surface of the peripheral margin of the manhole. A bolt port formed in the lower section is positioned for coaxial alignment with the bolt port formed in the upper section, for receiving a support bolt passed upwardly therethrough and threadably engaged with the nut for temporarily connecting and aligning the lower section in suspended relation with the upper section. In this orientation, the lock post on the upper section protrudes downwardly through a post port formed in the lower section and is disposed within the depending containment sleeve carried by said lower section. The lock unit is slidably fitted upwardly into the containment sleeve for locked engagement with the lock post. Shims may be interposed between the lock unit and the lower section for positioning and retaining the lower section with the peripheral rim thereon relatively tight seated engagement with the underside peripheral margin of the manhole.

In the preferred form, the lock unit comprises a generally cylindrical lock cartridge having an armored steel construction, with a reciprocal core pin movable between a locked position advanced into locking engagement with the lock post, and a key-actuated unlocked position retracted from the lock post. A keyway is exposed laterally through a vertically elongated slot formed in the containment sleeve for key-actuated unlocking and removal of the lock unit, in the event that access to and through the manhole is desired. At other times, the containment sleeve substantially conceals or disguises the location of the keyway from view to discourage attempted tampering. The secondary barrier may comprise an arcuate wall depending from the lower section in relatively short laterally spaced relation from the containment sleeve and the keyway slot formed therein. This secondary barrier thus restricts and minimizes the available space for keyway access, and thereby prevents or restricts access to the keyway by most tools of the type typically employed by unauthorized persons to tamper with or damage the lock unit.

Other features and advantages of the invention will become more apparent from the following detailed description taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
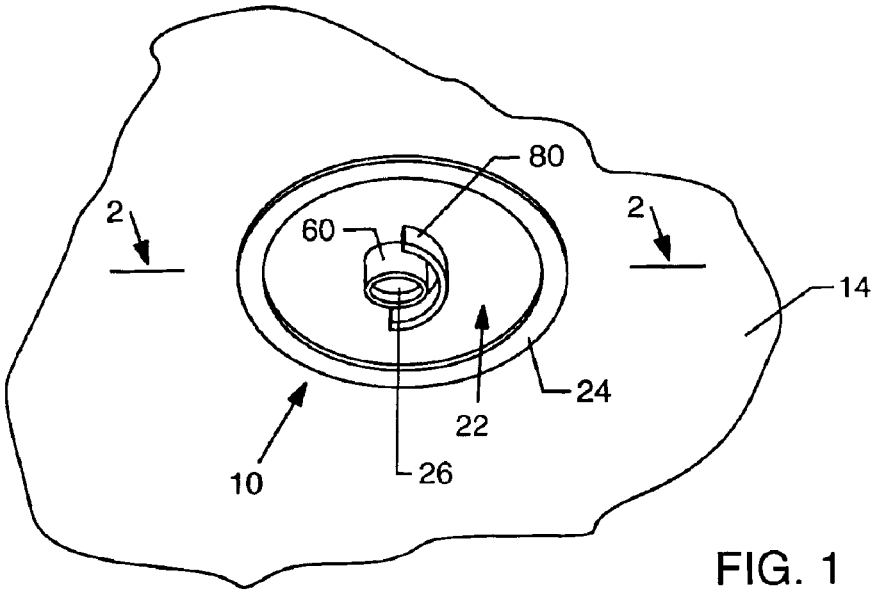
FIG. 1 is a bottom or underside perspective view of a locking cover in accordance with the novel features of the invention shown mounted over and closing a soffit manhole or access opening.
Figure 2:
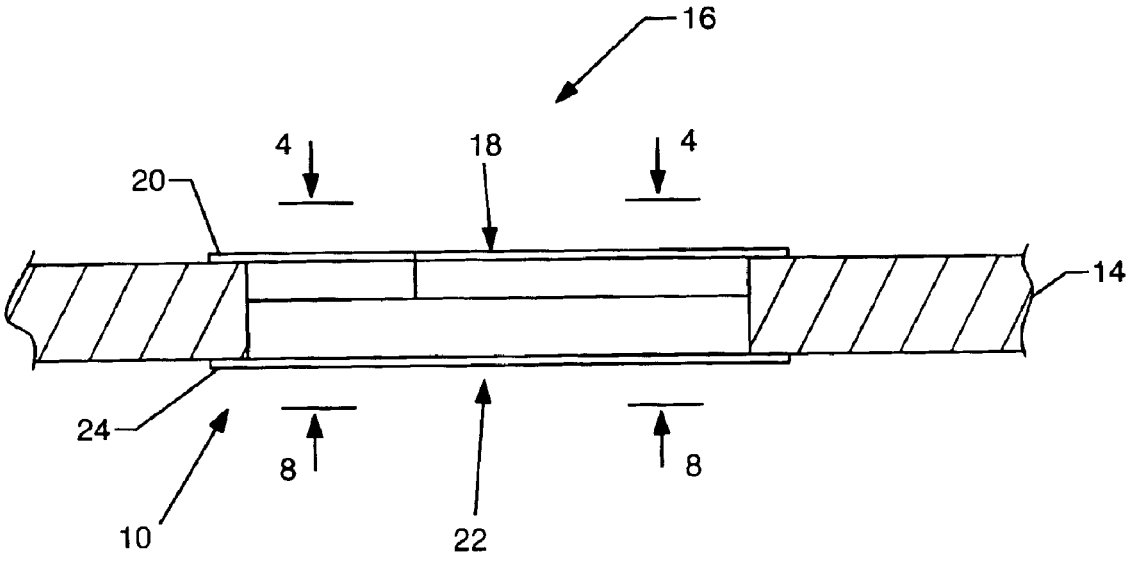
FIG. 2 is an enlarged fragmented vertical sectional view taken generally on the line 2—2 of FIG. 1, with the locking cover depicted in side elevation.
Figure 3:
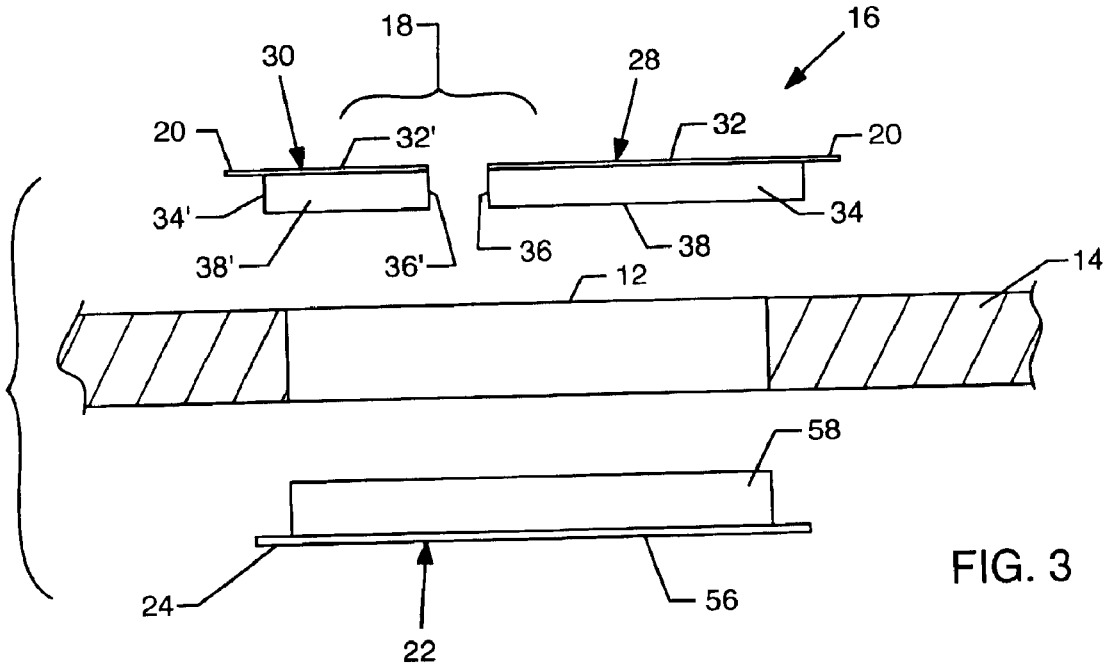
FIG. 3 is a fragmented vertical sectional view similar to FIG. 2, but illustrating upper and lower sections forming the locking cover in side elevation and in exploded relation with a soffit structure having a manhole formed therein.

As shown in the exemplary drawings, a locking cover referred to generally by the reference numeral 10 in FIGS. 1–3 is provided for closing and locking a manhole or access opening 12 (FIGS. 2–3) formed in an overhead soffit structure 14, to substantially preclude unauthorized access to an overhead cell or chamber 16 disposed above the soffit structure. The locking cover 10 generally comprises an upper section 18 having a first peripheral rim 20 thereon for overlying and resting upon an upper surface of the soffit 14 circumscribing the manhole 12, in combination with a lower section 22 having a second peripheral rim 24 thereon for seating firmly against a lower soffit surface circumscribing the manhole 12. A lock unit 26 removably secures the lower section 22 to the upper section 18, with the peripheral margin of the manhole 12 clamped in sandwiched relation between the overlying and underlying first and second peripheral rims 20 and 24.

The locking cover 10 of the present invention is particularly designed for preventing unauthorized entry into hollow spaces contained typically within concrete overpass and bridge structures of the type used in rail and highway transportation systems. Such hollow spaces are normally substantially enclosed, and may be vacant or otherwise contain equipment or facilities such as components of a public utility system, e.g., water mains, sewer drain pipes, and electrical wiring and related conduits. Access to such spaces is obtained from below by climbing upwardly through one or more typically circular manhole openings. The locking cover 10 of the present invention is designed for precluding access by unauthorized persons such as vagrants or vandals seeking to use such hollow spaces as living quarters, or to damage the structure or the equipment and facilities carried thereby. In the preferred form, the cover 10 is constructed from heavy gauge painted steel or the like to provide a strong, substantially tamper-proof product. While the invention is shown and described herein for controlling access to soffit spaces formed in overpass and bridge structures, persons skilled in the art will recognize and appreciate that the locking cover 10 may be employed in other types of structures for controlling access through a manhole, hatch, or other type of access opening.

As shown in FIGS. 2–7, and in accordance with one preferred form of the invention, the upper section 18 of the locking cover 10 comprises a plurality of individual segments such as the illustrative pair of segments 28 and 30 each having a size and shape to fit freely through the manhole 12 prior to assembly thereof. More particularly, in the case of a typically circular manhole 12, such as a circular opening having a standard diametric size on the order of about 32.5 inches, the segments 28 and 30 each have a part-circular shape and are adapted for quick and easy assembly subsequent to upward passage through the manhole 12 to define the upper section 18 having a generally circular shape to fit slidably into and thereby extend across and preferably close the manhole 12, with the peripheral rim 20 resting upon an upper surface of the soffit 14 bounding the peripheral margin of the manhole 12.

Figure 4:
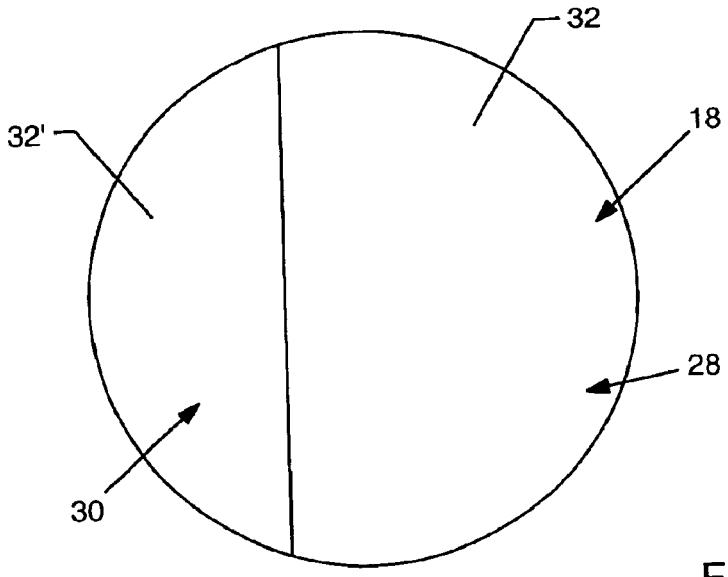
FIG. 4 is a top plan view of an assembled upper section of the locking cover, taken generally on the line 44 of FIG. 2.
Figure 5:
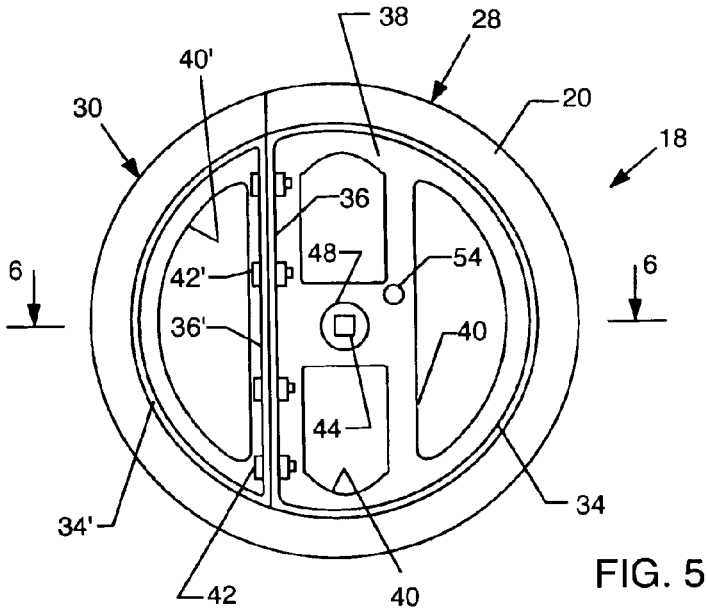
FIG. 5 is a bottom plan view of the assembled upper section of the locking cover.
Figure 6:
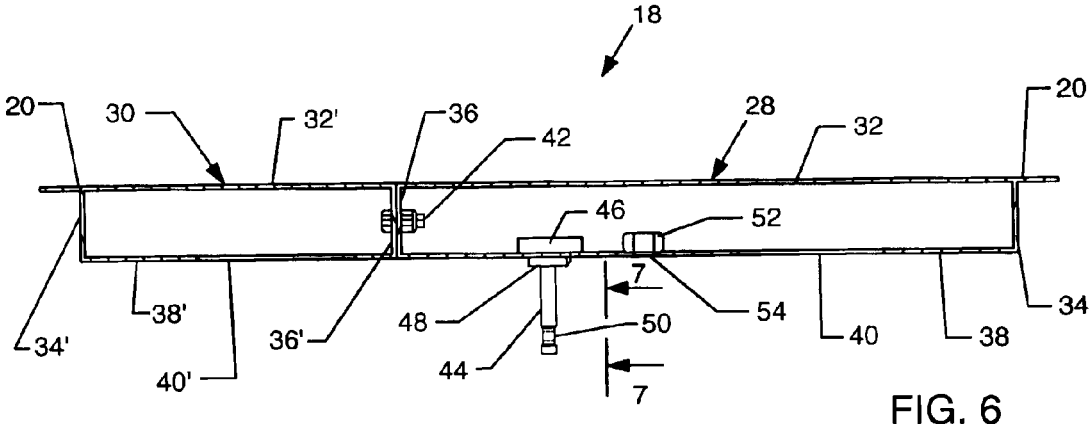
FIG. 6 is an enlarged vertical sectional view taken generally on the line 6—6 of FIG. 5.
Figure 7:
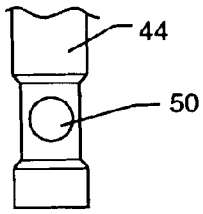
FIG. 7 is an enlarged and fragmented side elevation view of a portion of a connector pin carried by the upper section of the locking cover.
Figure 8:
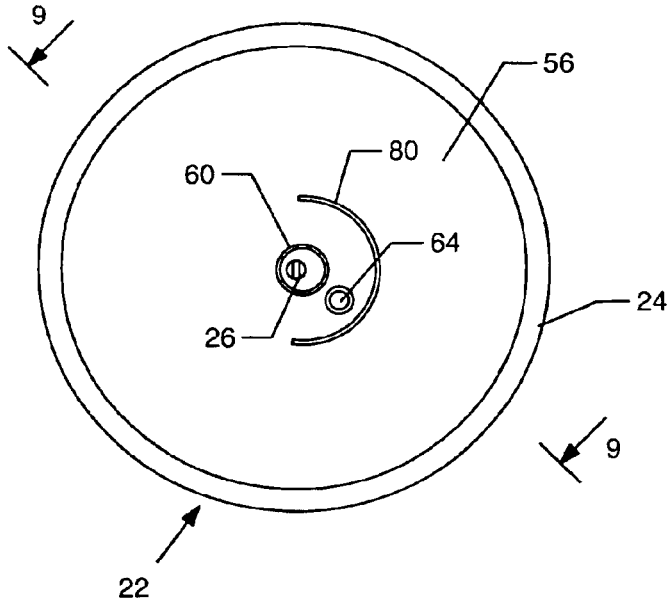
FIG. 8 is a bottom plan view of a lower section of the locking cover, taken generally on the line 8—8 of FIG. 2.

More specifically, the first part-circle upper segment 28 is shown to include a part-circle upper plate 32 having a peripheral margin defining a portion of the rim 20 which extends through an arcuate span greater than 180°, such as an arcuate span of about 220° as shown best in FIG. 4. A boundary wall 34 of part-circle shape depends from the upper plate 32, from a position radially inset a short distance from the outermost peripheral margin of the upper plate 34. This boundary wall 34 is formed with a part-circle shape that extends through the same arcuate span as the upper plate 32 and is generally concentric therewith. The boundary wall 34 is formed with a diametric size slightly less than the diametric size of the manhole 12 for slide-fit reception therein, with the peripheral portion of the upper plate 32 extending radially outwardly beyond the boundary wall 34 to define the upper rim 20. Both the upper plate 32 and the boundary wall 34 are truncated along a common chord line, with the opposite ends of the boundary wall 34 interconnected by a chord wall 36. The lower margins of the boundary wall 34 and chord wall 36 are joined in turn to an inboard plate 38 (FIGS. 5–6) having at least one and preferably a plurality of open access ports 40 formed therein.

The second part-circle segment 30 of the upper section 18 has a similar construction but a small arcuate span, in comparison with the first segment 28. That is, the second segment 30 has a part-circle upper plate 32' having a peripheral margin defining a portion of the rim 20 and extending through an arcuate span less than 180°, such as an arcuate span of about 140° as shown best in FIG. 4. A boundary wall 34' of part-circle shape depends from the upper plate 32', from a position radially inset a short distance from the outermost peripheral margin thereof. Once again, this boundary wall 34' is formed with a part-circle shape that extends through the same arcuate span as the upper plate 32', is generally concentric therewith, and is formed with a diametric size slightly less than the diametric size of the manhole 12 for slide-ft reception therein with the peripheral portion of the upper plate 32' extending radially outwardly beyond the boundary wall 34' to define a portion of the upper rim 20. Both the upper plate 32' and the boundary wall 34' are truncated along a common chord line, with the opposite ends of the boundary wall 34' interconnected by a chord wall 36'. The lower margins of the boundary wall 34' and chord wall 36' are again joined in turn to an inboard plate 38' (FIGS. 5–6) having at least one open access port 40' formed therein.

This pair of part-circle segments 28 and 30 are adapted for quick and easy interconnection subsequent to upward passage through the manhole 12. In particular, the two segments 28 and 30 are assembled with their chord walls 36, 36' in face-to-face abutting relation, and then securely fastened together by appropriate fastening means such as the illustrative plurality of connector bolts 42 shown in FIGS. 5–6. The open access ports 40, 40' permit the assembler to reach into the hollow interiors of the part-circle segments 28, 30 for installing these connector bolts 42. In the assembled state, the two part-circle segments 28,30 cooperatively define the generally circular upper section 18 forming the annular peripheral rim 20 for rested support on the upper surface of the soffit 14 bounding or circumscribing the manhole 12. In this position, the boundary walls 34, 34' of the assembled segments cooperatively define a substantially full-circle cylindrical structure sized for slide-fit reception downwardly into the manhole 12.

In accordance with further aspects of the invention, the upper section 18 of the locking cover 10 further includes a lock post 44 carried at a generally centered position and protruding downwardly therefrom. In the preferred form, this lock post 44 includes an enlarged upper head 46 (FIGS. 6 and 11–13) rigidly secured onto an upper side of the inboard plate 38 of the part-circle segment 28, as by welding or other suitable connection means. This head 46 is joined to an underlying shoulder 48 which extends downwardly therefrom and protrudes at least a short distance beyond a lower side of the inboard plate 38. The lock post 44 in turn extends downwardly from the shoulder 48, and includes a transversely or laterally open lock port 50 (FIG. 7) formed therein near a distal or lower end thereof.

In addition, a mounting nut 52 is carried by the upper section 18 for use in temporarily connecting and supporting the lower section 22 therefrom. In the preferred form as shown, this mounting nut 52 is captured onto an upper side of the inboard plate 38 of the part-circle segment 28, as by welding of other suitable connection means, in coaxial alignment with an underlying bolt port 54 formed in the plate 38. The location of the mounting nut 52 and associated bolt port 54 are chosen to be offset a short distance from the generally centered location of the lock post 44. Alternative nut support means such as a shroud (not shown) for capturing the nut 52 with limited floating capability in general alignment with the underlying bolt port 54 may also be used, if desired.

The lower section 22 of the locking cover 10 is shown in 1–3 and 8–10. As shown, this lower section 22 comprises a generally circular plate 56 joined at its periphery to a downwardly extending, generally circular boundary wall 58 having a diametric size corresponding generally to the diametric size of the assembled boundary walls 34, 34' of the upper section 18. Accordingly, the circular plate 56 and associated boundary wall 58 of the lower section are sized for slide-fit reception upwardly into the manhole 12 for extending across and closing the manhole opening. The lower margin of the boundary wall 58 of the lower section 22 is joined to the radially outwardly extending peripheral rim 24 sized to overlie and engage the underside surface of the soffit 14 bounding or circumscribing the manhole 12.

Figure 9:
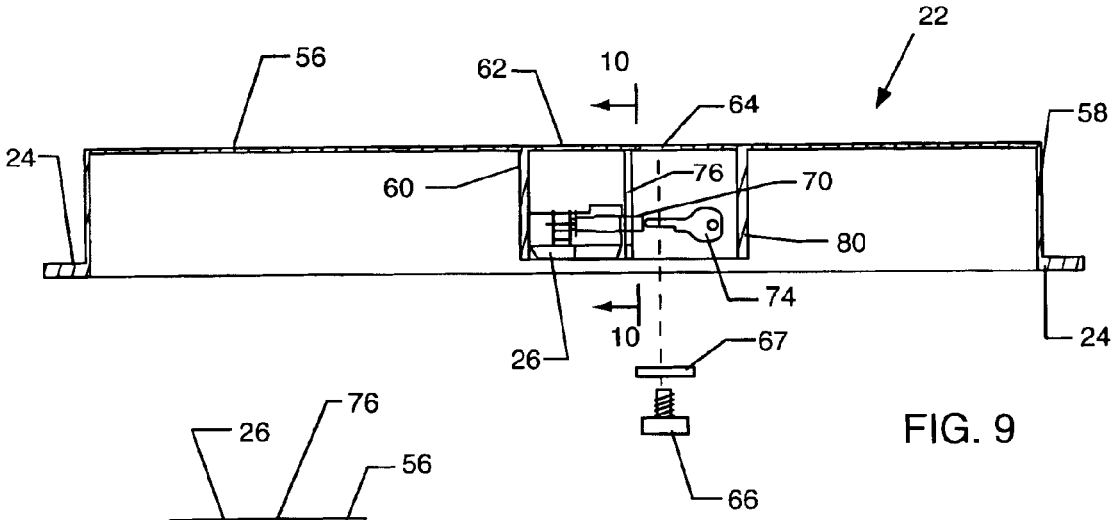
FIG. 9 is an enlarged vertical sectional view taken generally on the line 9—9 of FIG. 8.

A generally cylindrical lock containment sleeve 60 is connected as by welding or other suitable attachment means to the underside of the circular plate 56 of the lower section 22 at a generally axially centered location, and protrudes downwardly therefrom with a lower margin terminating generally at or slightly above the plane of the peripheral rim 24. This containment sleeve 60 has a size and shape for upward slide-fit reception of the lock unit 26, as will be described in more detail. A post port (FIG. 9) is formed in the circular plate 56 within the region bounded by the containment sleeve 60, and this post port 62 is sized for slide-fit reception of the depending shoulder 48 (FIGS. 11–13) formed at the upper end of the lock post 44 projecting downwardly from the upper section 18 of the locking cover 10. In addition, a bolt port 64 is formed in the plate 56 af a location near but offset a short distance to one side of the containment sleeve 60.

The lower section 22 is connected to the upper section 18 subsequent to seated positioning of the upper section 18 within the manhole 12. A support bolt 66 with associated washer 67 (FIGS. 9 and 11–13) is passed upwardly through the bolt port 64 in the lower section plate 56, and further upwardly through the bolt port 54 formed in the inboard plate 38 of the part-circle segment 28 of the upper section 18. Fastening of the support bolt 66 in threaded engagement with the nut 52 on the upper section 18 provides a temporary connection suspending and supporting the weight of the lower section 22 pending subsequent installation of the lock unit 26. Importantly, in this temporarily connected orientation, the post port 62 formed in the lower section plate 56 partially receives the shoulder 48 of the lock post 44 (FIGS. 11–13) which extends downwardly into the interior of the containment sleeve 60. Alternative interconnecting support members formed on the upper and lower section 18 and 22 for temporarily supporting the lower section 22 pending installation of the lock unit 26 will be apparent to persons skilled in the art.

Figure 10:
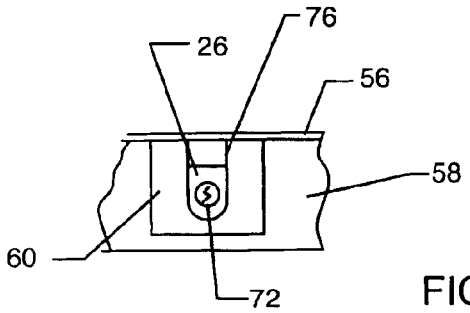
FIG. 10 is a further enlarged vertical sectional view taken generally on the line 10—10 of FIG. 9.
Figure 12:
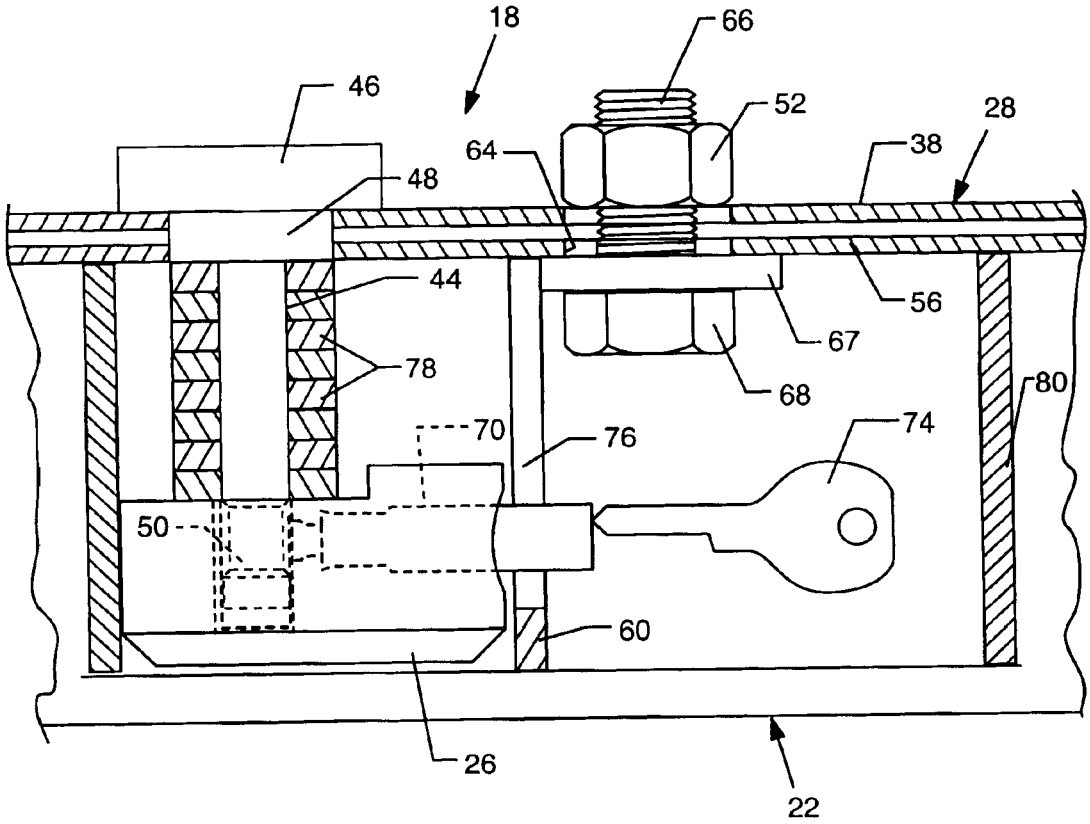
FIG. 12 is a fragmented, and partially exploded vertical sectional view similar to FIG. 11, but depicting further steps for mounting the lower section to the assembled upper section of the locking cover.

The lock unit 26 can then be slidably fitted upwardly into the containment sleeve 60, for releasible locked engagement with the lock post 44 on the upper section 18, thereby securely interconnecting the lower section 22 to the upper section 18. More particularly, in one preferred form, the lock unit 26 may comprise an armored steel lock cartridge having a generally cylindrical shape, such as Product Numbers 6270 or 970, available from Master Lock Company, Oak Creek, Wis., or equivalent, including an upwardly open port 68 for slide-fit reception of a lower end of the lock post 44, and a laterally reciprocal core pin 70 adapted for movement between a locked position advanced into the lock port 50 for locking engagement with the lock post 44 (FIG. 13), and an unlocked position retracted from the lock post 44 (FIG. 12). This core pin 70 is provided as part of a suitable tumbler set including a laterally presented key slot or keyway 72 (FIG. 10) exposed laterally for access by a key 74 through a vertically elongated slot 76 formed in the containment sleeve 60.

Figure 11:
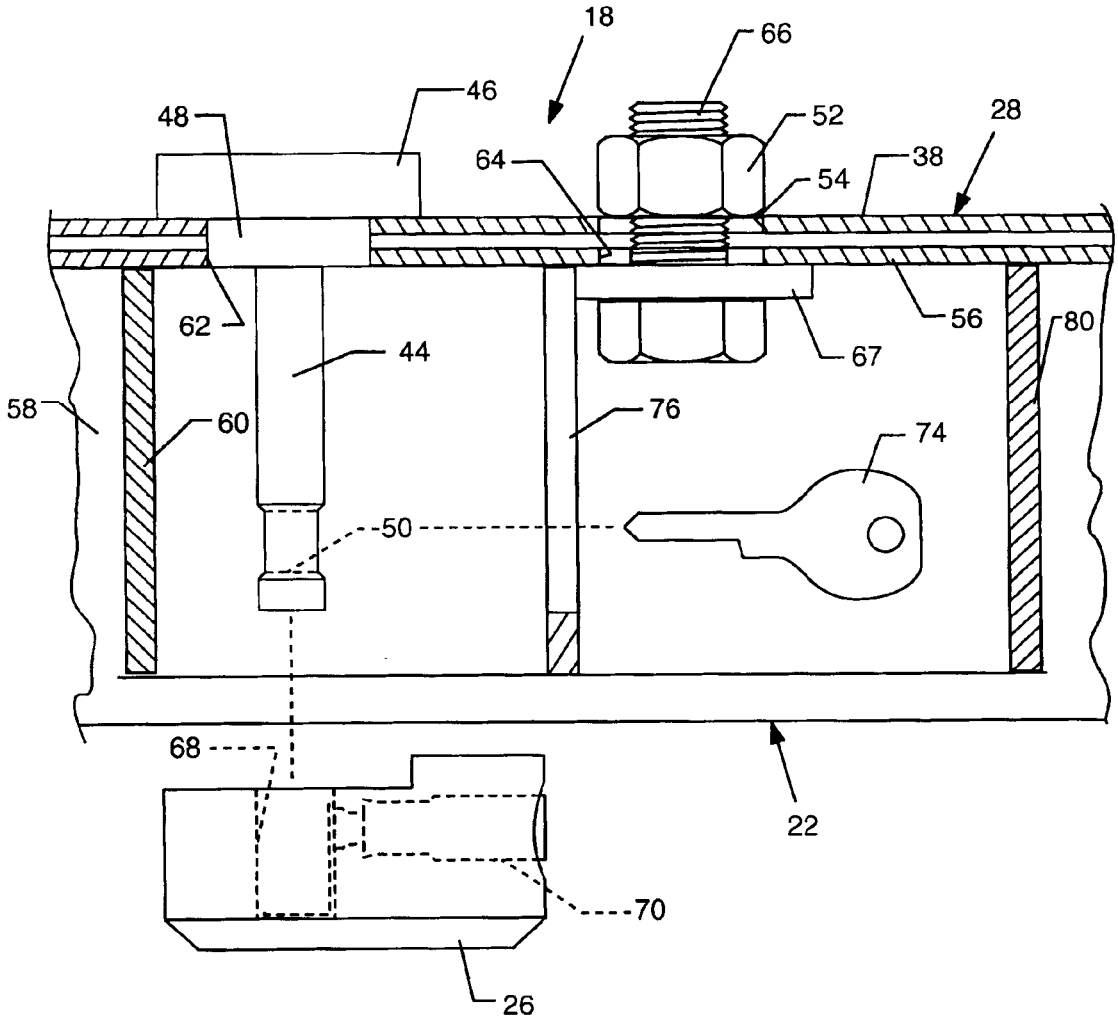
FIG. 11 is an enlarged, fragmented, and partially exploded vertical sectional view illustrating initial steps for mounting the lower section to the assembled upper section of the locking cover.
Figure 13:
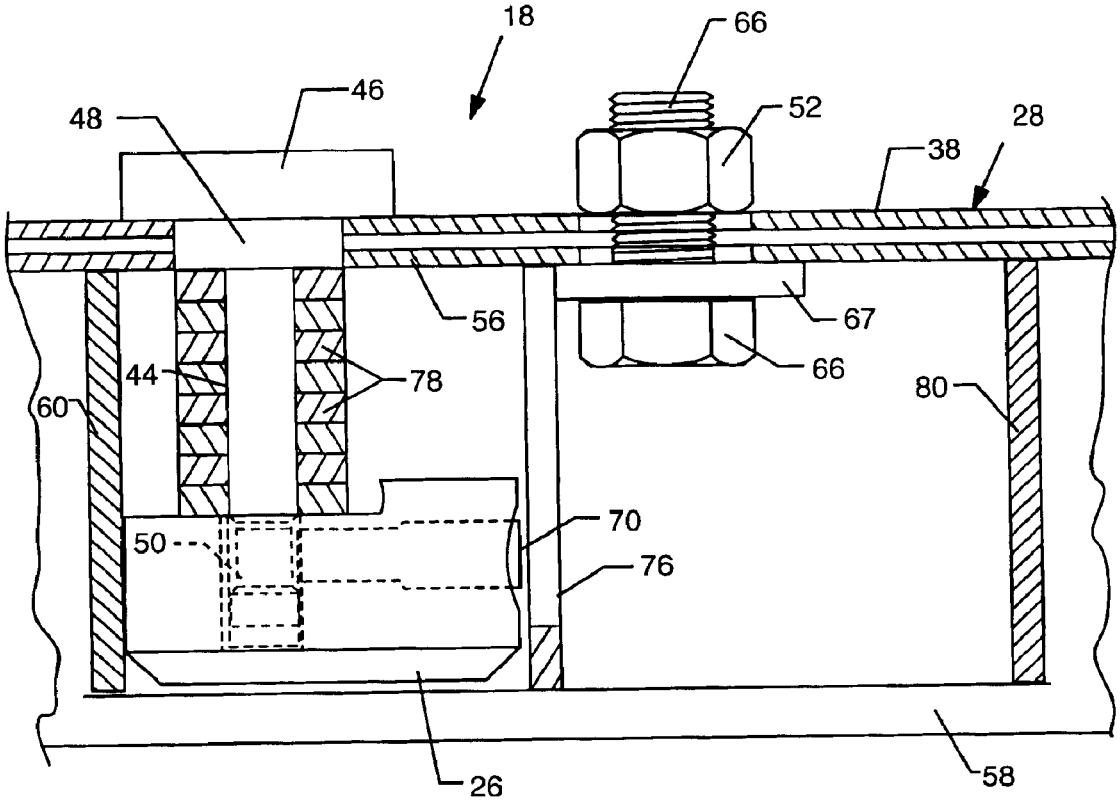
FIG. 13 is another fragmented vertical sectional view similar to FIGS. 11 and 12, and showing the lower section in removably locked relation with the assembled upper section of the locking cover.

In use, as viewed in FIG. 11, the lock unit 26 is slidably fitted upwardly into the containment sleeve 60, with the core pin 70 in an initial advanced or locked position. Within the containment sleeve 60, the key 74 is inserted through the containment sleeve slot 76 and into the keyway 72 for key-actuated retraction of the core pin 70 to the unlocked position shown in FIG. 12. In such unlocked position, the core pin 70 extends partially through the containment sleeve slot 76. With the lock unit 26 positioned for receiving the lock post 44 into the lock unit port 68, the core pin 70 can be manually displaced typically with a detent action to the advanced and locked position with a distal or free end of the core pin 70 passed through the lock port 50 formed in the lock post 44 (FIG. 13). At least one and typically a selected plurality of shim elements 78 (FIGS. 12–13) such as a stack of metal washers or the like are desirably fitted about the lock post 44 prior to or concurrently with the above-described installation of the lock unit 26, wherein these shims 78 retain provide a fixed spacing between the underside of the lower section plate 56 and an upper face of the lock unit 26, for retaining the lower section 22 in a position with its peripheral rim 24 seated snugly against the underside soffit surface surrounding the manhole 12. In this regard, in the case of a relatively thin soffit 14, the circular plate 56 of the lower section 22 may be positioned substantially in abutting relation or closely spaced from the overlying inboard plates 38, 38' of the assembled upper section 18. For a manhole 12 formed in a thicker soffit structure 14, these plates 56 and 38, 38' may be spaced farther apart and a reduced number of the shims 78 may be used to position the lower rim 24 snugly against the soffit 14.

In this installed orientation, the locking cover 10 of the present invention provides a low profile structure for securely closing the manhole 12, with minimal protruding structures having a shape conducive to tampering as by prying and the like. The peripheral rim 24 of the lower section 22 is snugly retained against the soffit 14 to provide little or no access for the tip of a pry bar or tool. The containment sleeve 60 effectively surrounds the lock unit 26 to conceal and disguise the manner in which the cover components are assembled and locked together, with the lower end of the vertical slot 76 in the containment sleeve 60 being closed to conceal the inset keyway 72 on the core pin 70 in the advanced and locked position. Accordingly, the locking cover 10 is highly secure to safeguard against unauthorized access to the cell or chamber 16 disposed above the manhole 12. In addition, the locking cover 10 is highly resistant to attempted tampering by unauthorized persons. However, the key-actuated lock unit 26 can be separated quickly and easily from the lock post 44 to accommodate disassembly of the locking cover by authorized personnel. In such disassembly, the support bolt 66 is removed following lock unit removal to permit drop-away disassembly of the lower section 22. The upper section 18 can then be lifted and slidably shifted aside for unimpeded access upwardly through the manhole 12.

In the event that additional security against unauthorized tampering is desired or required, a secondary barrier in the form of an arcuate wall barrier wall 80 may be optionally provided to depend from the circular plate 56 of the lower section 22 in relatively short laterally spaced relation at one side of the containment sleeve 60 at a position generally shielding the vertically elongated slot 76 formed therein. This barrier wall 80 is shown in the illustrative drawings in the form of a generally semicircular wall having its upper end connected as by welding to the plate 56, and a lower margin terminating generally coplanar with a lower margin of the containment sleeve 60. The barrier wall 80 further conceals and disguises the location of the key slot 72 on the locked core pin 70, while providing sufficient but minimal lateral space for manually holding and manipulating the key 74 to operate the lock unit 26. In general, this secondary barrier is preferred for use with a locking cover 10 to be installed relatively close to a ground floor or surface, but is typically not indicated when the locking cover 10 is installed at a substantial elevation, e.g., about 14 feet or higher above a ground floor or surface.

A variety of further modifications and improvements in and to the locking cover 10 of the present invention will be apparent to those persons skilled in the art. Accordingly, no limitation on the invention is intended by way of the foregoing description and accompanying drawings, except as set forth in the appended claims.

What is claimed is:

1. A locking cover for closing a manhole formed in a soffit, said locking cover comprising:

an upper section having a size and shape for extending across a soffit manhole and including a first peripheral rim for engaging an upper soffit surface circumscribing the manhole;

said upper section including at least two segments each having a size and shape for passage through the manhole, and said upper section further including means for assembling said at least two segments to form said upper section and to cooperatively define said first peripheral rim;

a lower section having a size and shape for closing the soffit manhole and including a second peripheral rim for engaging a lower soffit surface circumscribing the manhole; and a lock unit for lockably interconnecting said upper and lower sections with a peripheral margin of the manhole formed by said soffit being sandwiched between said first and second peripheral rims.

2. The locking cover of claim 1 wherein said upper and lower sections each have a generally circular shape.

3. The locking cover of claim 1 wherein said at least two segments comprises a pair of part-circle segments cooperatively defining when assembled said upper section having a generally circular shape.

4. The locking cover of claim 3 wherein one of said pair of part-circle segments has an arcuate span greater than 180°, and the other of said pair of part-circle segments has an arcuate span less than 180°.

5. The locking cover of claim 1 further including a lock post carried by said upper section, and a post port formed in said lower section for slide-through passage of said lock post, said lock unit including means for releasibly engaging said lock post for lockably retaining said lower section in assembled relation with said upper section.

6. The locking cover of claim 5 further including at least one shim element interposed between said lock unit and said lower section for positioning said lower section with said second peripheral rim substantially seated against said lower soffit surface, when said lock unit is engaged with said lock post.

7. A locking cover for closing a manhole formed in a soffit, said locking cover comprising:

an upper section having a size and shape for extending across a soffit manhole and including a first peripheral rim for engaging an upper soffit surface circumscribing the manhole;

a lower section having a size and shape for closing the soffit manhole and including a second peripheral rim for engaging a lower soffit surface circumscribing the manhole;

a lock post carried by said upper section, and a post port formed in said lower section for slide-through passage of said lock post; and a lock unit for lockably interconnecting said upper and lower sections with a peripheral margin of the manhole formed by said soffit being sandwiched between said first and second peripheral rims, said lock unit including means for releasibly engaging said lock post for lockably retaining said lower section in assembled relation with said upper section;

said lock unit comprising a lock cartridge having a core pin movable between an advanced locked position and a retracted unlocked position, said lock post having a lock port formed therein for slide-fit reception of said core pin in said locked position.

8. A locking cover for closing a manhole formed in a soffit, said locking cover comprising:

an upper section having a size and shape for extending across a soffit manhole and including a first peripheral rim for engaging an upper soffit surface circumscribing the manhole;

a lower section having a size and shape for closing the soffit manhole and including a second peripheral rim for engaging a lower soffit surface circumscribing the manhole;

a lock post carried by said upper section, and a post port formed in said lower section for slide-through passage of said lock post;

a lock unit for lockably interconnecting said upper and lower sections with a peripheral margin of the manhole formed by said soffit being sandwiched between said first and second peripheral rims, said lock unit including means for releasibly engaging said lock post for lockably retaining said lower section in assembled relation with said upper section; and further including means for supporting said lower section from said upper section when said lock unit is disengaged from said lock post.

9. The locking cover of claim 8 wherein said supporting means comprises a bolt.

10. The locking cover of claim 9 further including a nut carried in a captured position by said upper section for receiving said bolt passed upwardly through said lower section.

11. A locking cover for closing a manhole formed in a soffit, said locking cover comprising:

an upper section having a size and shape for extending across a soffit manhole and including a first peripheral rim for engaging an upper soffit surface circumscribing the manhole;

a lower section having a size and shade for closing the soffit manhole and including a second peripheral rim for engaging a lower soffit surface circumscribing the manhole;

a lock post carried by said upper section, and a lost port formed in said lower section for slide-through passage of said lock post;

a lock unit for lockably interconnecting said upper and lower sections with a peripheral margin of the manhole formed by said soffit being sandwiched between said first and second peripheral rims, said lock unit including means for releasibly engaging said lock post for lockably retaining said lower section in assembled relation with said upper section; and further including a containment sleeve carried by said lower section in a position surrounding said lock post when said upper and lower sections are lockably interconnected, said lock unit comprising a lock cartridge having a size and shape for slide-fit reception upwardly within said containment sleeve for locking engagement with said lock post.

12. The locking cover of claim 11 wherein said lock cartridge has an upwardly open port formed therein for slidably receiving a lower end of said lock post, and a laterally reciprocal core pin movable between an advanced position lockingly engaged with said lock post and a retracted position disengaged from said lock post.

13. The locking cover of claim 12 wherein said core pin has a laterally open key slot exposed through said containment sleeve for key-actuated movement of said core pin from said advanced to said retracted positions.

14. The locking cover of claim 13 wherein said containment sleeve has a vertically elongated slot formed therein for laterally exposing said key slot.

15. The locking cover of claim 14 wherein said vertically elongated slot formed in said containment sleeve is closed at a lower end thereof.

16. A locking cover for closing a manhole formed in a soffit, said locking cover comprising:

an upper section having a size and shape for extending across a soffit manhole and including a first peripheral rim for engaging an upper soffit surface circumscribing the manhole;

a lower section having a size and shape for closing the soffit manhole and including a second peripheral rim for engaging a lower soffit surface circumscribing the manhole;

a lock post carried by said upper section, and a post port formed in said lower section for slide-through passage of said lock post; and a lock unit for lockably interconnecting said upper and lower sections with a peripheral margin of the manhole formed by said soffit being sandwiched between said first and second peripheral rims, said lock unit including means for releasibly engaging said lock post for lockably retaining said lower section in assembled relation with said upper section;

said lock post having an enlarged shoulder for at least partial reception into said post port formed in said lower section.

17. The locking cover of claim 12 further including a secondary barrier wall extending downwardly from said lower section in relatively close spaced relation with said containment sleeve at one side thereof to restrict access to said core pin.

18. A locking cover for closing a manhole formed in a soffit, said locking cover comprising:

an upper section including at least two segments each having a size and shape for separate passage upwardly through a soffit manhole and adapted for assembly at a location above the manhole to form said upper section having a size and shape for extending across the manhole and including a first peripheral rim for engaging an upper soffit surface circumscribing the manhole;

a lock post carried by said upper section and extending downwardly therefrom;

a lower section having a size and shape for extending across and closing the soffit manhole and including a second peripheral rim for engaging a lower soffit surface circumscribing the manhole;

said lower section having a post port formed therein for slide-through passage of said lock post, and a containment sleeve carried by said lower section and extending downwardly therefrom in surrounding relation to said lock post; and a lock unit for lockably interconnecting said upper and lower sections with a peripheral margin of the manhole formed by said soffit being sandwiched between said first and second peripheral rims, said lock unit including a lock cartridge within said containment sleeve and including means for releasibly engaging said lock post for lockably retaining said lower section in assembled relation with said upper section.

19. The locking cover of claim 18 further including at least one shim element interposed between said lock unit and said lower section for positioning said lower section with said second peripheral rim substantially seated against said lower soffit surface, when said lock unit is engaged with said lock post.

20. The locking cover of claim 18 further including means for supporting said lower section from said upper section when said lock unit is disengaged from said lock post.

21. The locking cover of claim 20 wherein said supporting means comprises a bolt.

22. The locking cover of claim 21 further including a nut carried in a captured position by said upper section for receiving said bolt passed upwardly through said lower section.

23. The locking cover of claim 18 wherein said lock cartridge is slidably carried within said containment sleeve.

24. The locking cover of claim 18 wherein said lock cartridge has an upwardly open port formed therein for receiving a lower end of said lock post, and a laterally reciprocal core pin movable between an advanced position lockingly engaged with said lock post and a retracted position disengaged from said lock post.

25. The locking cover of claim 24 wherein said core pin has a laterally open key slot exposed through said containment sleeve for key-actuated movement of said core pin from said advanced to said retracted positions.

26. The locking cover of claim 25 wherein said containment sleeve has a vertically elongated slot formed therein for laterally exposing said key slot.

27. The locking cover of claim 26 wherein said vertically elongated slot formed in said containment sleeve is closed at a lower end thereof.

28. The locking cover of claim 18 wherein said lock post has an enlarged shoulder for at least partial reception into said post port formed in said lower section.

29. The locking cover of claim 25 further including a secondary barrier wall extending downwardly from said lower section in relatively close spaced relation with said containment sleeve at one side thereof to restrict access to said core pin.

30. A locking cover for closing a manhole formed in a soffit, said locking cover comprising:

an upper section including at least two segments each having a size and shape for separate passage upwardly through a soffit manhole and adapted for assembly at a location above the manhole to form said upper section having a size and shape for extending across the manhole and including a first peripheral rim for engaging an upper soffit surface circumscribing the manhole, and a lock post carried by said upper section and extending downwardly therefrom;

a lower section having a size and shape for extending across and closing the soffit manhole and including a second peripheral rim for engaging a lower soffit surface circumscribing the manhole, said lower section further including a post port formed therein said lower section for slide-through passage of said lock post, and a containment sleeve carried by said lower section and extending downwardly therefrom in surrounding relation to said lock post; and a lock unit for lockably interconnecting said upper and lower sections with a peripheral margin of the manhole formed by said soffit being sandwiched between said first and second peripheral rims, said lock unit comprising a lock cartridge within said containment sleeve and including means for releasibly engaging said lock post for lockably retaining said lower section in assembled relation with said upper section.

31. The locking cover of claim 30 further including at least one shim element interposed between said lock unit and said lower section for positioning said lower section with said second peripheral rim substantially seated against said lower soffit surface, when said lock unit is engaged with said lock post.

32. The locking cover of claim 30 further including means for supporting said lower section from said upper section when said lock unit is disengaged from said lock post.

33. The locking cover of claim 30 wherein said lock cartridge is slidably carried within said containment sleeve.

34. The locking cover of claim 30 wherein said lock cartridge has an upwardly open port formed therein for receiving a lower end of said lock post, and a laterally reciprocal core pin movable between an advanced position lockingly engaged with said lock post and a retracted position disengaged from said lock post.

35. The locking cover of claim 34 wherein said core pin has a laterally open key slot exposed through said containment sleeve for key-actuated movement of said core pin from said advanced to said retracted positions.

36. The locking cover of claim 35 wherein said containment sleeve has a vertically elongated slot formed therein for laterally exposing said key slot, said vertically elongated slot formed in said containment sleeve being closed at a lower end thereof.

37. The locking cover of claim 35 further including a secondary barrier wall extending downwardly from said lower section in relatively close spaced relation with said containment sleeve at one side thereof to restrict access to said core pin.

38. A method of installing a locking cover for closing a manhole formed in an overhead soffit, said method comprising the steps of:

forming an upper section from a plurality of segments each having a size and shape for individual passage upwardly through manhole, and wherein said segments are adapted for assembly to form the upper section having a first rim for engaging an upper soffit surface circumscribing the manhole;

passing the upper sections segments in unassembled form upwardly through the manhole;

assembling the upper section segments at a location above the manhole to form an assembled upper section;

positioning the assembled upper section to extend across the manhole with said first rim engaging at least a portion of the upper soffit surface circumscribing the manhole;

forming a lower section having a size and shape for extending across and covering the manhole, and including a second rim for engaging a lower soffit surface circumscribing the manhole;

positioning the lower section to close the manhole with said second rim engaging the lower soffit surface circumscribing the manhole; and releasibly locking the lower section to the upper section.

* * * * *